US006054929A

United States Patent [19]

Garofalo et al.

[11] Patent Number: 6,054,929

[45] Date of Patent: Apr. 25, 2000

[54] DEVICE FOR GIVING WARNING OF CONDITIONS OF DANGER FOR SCUBA DIVING

[75] Inventors: Giovanni Garofalo, Rapallo; Alberto Belloni, Recco, both of Italy

[73] Assignee: HTM Sport S.p.A., Italy

[21] Appl. No.: 09/026,172

[22] Filed: Feb. 19, 1998

[30] Foreign Application Priority Data

Feb. 19, 1997 [IT] Italy ..... GE97A0013

[51] Int. Cl.[7] ..... G08B 21/00

[52] U.S. Cl. ..... 340/626; 340/573.1; 340/825.45; 340/825.53; 340/676; 128/205.22; 128/205.23

[58] Field of Search ..... 340/676, 626, 340/573.1, 384.7, 815.4, 815.53, 815.45; 128/201.27, 205.22, 205.23, 205.24

[56] References Cited

U.S. PATENT DOCUMENTS

| | | | |
|---|---|---|---|
| 3,992,948 | 11/1976 | D'Antonio et al. | 235/184 |
| 4,152,848 | 5/1979 | Trinkwalder . | |
| 4,800,373 | 1/1989 | Mayz | 340/626 |
| 4,882,678 | 11/1989 | Hollis et al. | 73/865.1 |
| 5,191,317 | 3/1993 | Toth et al. | 340/676 |
| 5,357,242 | 10/1994 | Morgano et al. | 340/626 |
| 5,483,826 | 1/1996 | Schultz et al. | 73/146.5 |
| 5,506,571 | 4/1996 | Dugan | 340/626 |
| 5,738,092 | 4/1998 | Mock et al. | 128/205.23 |

FOREIGN PATENT DOCUMENTS

| | | |
|---|---|---|
| 0 324 259 | 7/1989 | European Pat. Off. . |
| 0 428 131 A2 | 5/1991 | European Pat. Off. . |
| 2 294 349 | 4/1996 | United Kingdom . |
| 88/06549 | 9/1988 | WIPO . |
| 92/06889 | 4/1992 | WIPO . |
| 93/00134 | 1/1993 | WIPO . |

*Primary Examiner*—Daniel J. Wu
*Attorney, Agent, or Firm*—Larson & Taylor

[57] ABSTRACT

A device worn by a first diver provides a warning of conditions of danger and/or emergency to a second diver positioned at a distance from the first diver. The device includes a device for detecting the pressure in the compressed-air tanks, a device for transducing the detected datum, and a device for indicating the aforesaid datum.

4 Claims, 3 Drawing Sheets

DEVICE FOR GIVING WARNING OF CONDITIONS OF DANGER FOR SCUBA DIVING

TECHNICAL FIELD OF THE INVENTION

The present invention relates to a device for issuing a warning signal indicating a condition of danger and/or emergency during scuba divings, and in particular during the diving in the presence of an instructor.

BACKGROUND OF THE INVENTION

During underwater training carried out in scuba diving courses, the pupils are required to warn the instructor when the pressure in the compressed-air tanks has dropped below 100 bar, and subsequently 50 bar. Since a single instructor is normally required to keep an eye on a team made up of a number of pupils, it is important that all the pupils may be able to communicate their datum to the instructor in the shortest time possible.

From the U.S. Pat. No. 5,357,242 a pressure gauge is known for detecting the pressure of the air in a compressed-air tank provided with an acoustic and optical alarm system, and with an adjustable alarm pointer which can be set at the pressure at which the alarm signal is activated. When the air pressure in the compressed-air tank reaches the alarm pressure limit set, an electric circuit closes and activates the alarm.

This device enables the setting of a single alarm pressure, and since it is adjustable, it can easily be tampered with; consequently, it is not very suitable for use in training courses.

From the U.S. Pat. No. 4,800,373 an alarm device is known, which is both acoustic and optical and suitable for detecting the pressure in a compressed-air tank; this device comprises a two-stage alarm system capable of indicating an initial low pressure and then a subsequent low danger-level pressure.

However, both these known devices are unsuitable for detection at a distance by an instructor who must monitor simultaneously a team of divers.

SUMMARY OF THE INVENTION

The purpose of the present invention is thus to provide a device that will enable the instructor to detect the datum for all his pupils in the simplest and fastest possible way.

The subject of this invention is therefore a device for giving warning of conditions of danger and/or emergency for scuba diving, characterized in that said device includes means of detection of the pressure in the compressed-air tanks, means of transducing the datum detected, and means of indicating the same datum that can be easily detected at a distance by an instructor.

Advantageously, said means of detection are connected to one of the high-pressure outputs of the first reducer stage of the two-stage breathing apparatus.

In one embodiment, said means of detection include a pressure sensor, and said means of transducing include a circuit that converts the pressure detected into a pulse, and a circuit that transmits it to the warning means, said means of detection and means of warning including LEDs arranged on the control panel of a computer for scuba diving of a known type.

In a second embodiment, said means of detection comprise an analogue or digital pressure gauge, the means of transducing include an electrical circuit which transmits the datum to said means of warning including LEDs arranged on said pressure gauge.

BRIEF DESCRIPTION OF THE DRAWINGS

Further advantages and characteristics of the present invention will appear more evident from the detailed description of some embodiments of the same, made to provide non-limiting examples, with reference to the attached drawings, where.

DESCRIPTION OF SOME PREFERRED EMBODIMENTS OF THE INVENTION

Figures 1, 2:
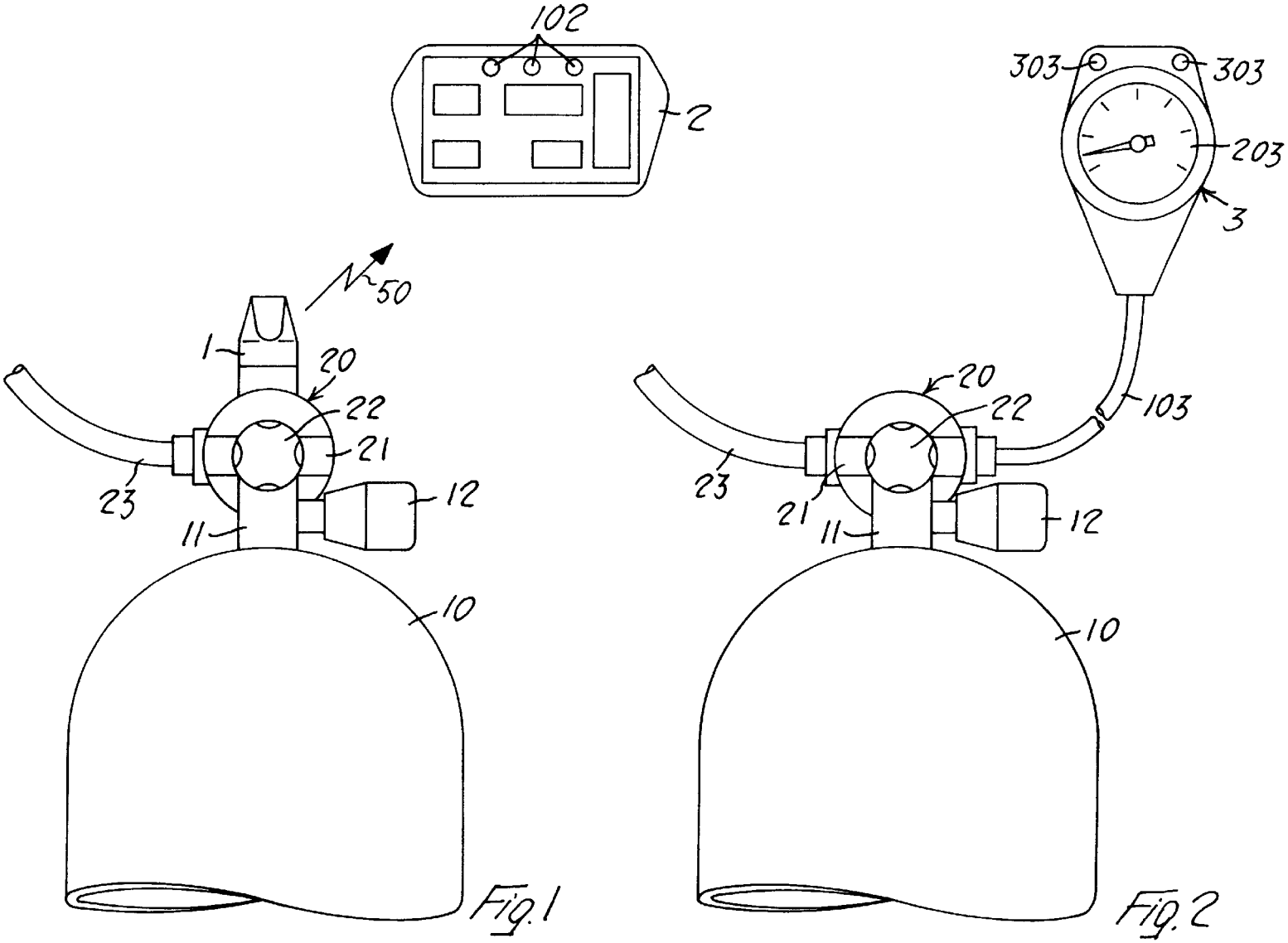
FIG. 1 is an elevation of an embodiment of the device of the invention.
FIG. 2 is an elevation of a second embodiment of the device of the invention.

FIG. 1 shows the device according to the invention in a schematic form. Number 1 indicates a device for detecting and transducing the pressure datum of a type which is per se known, including a pressure sensor and a transmitter communicating the signal 50 to the computer 2 for scuba diving, which is also of a known type. On the computer 2 are arranged the LEDs 102. The device 1 is connected to a high-pressure output of the first reducer stage 20 of a two-stage self-contained underwater breathing apparatus, which is in turn connected by a bracket 21 and the fixing knob 22 to the air-supply valve 11 of a compressed-air tank 10, said valve being equipped with the cock 12. To the body of the first reducer stage 20 is also connected the whip 23 connected to the second breathing apparatus stage, not illustrated herein.

FIG. 2 shows a second embodiment of the device according to the present invention. To the first reducer stage 20, which is connected to the compressed-air tank 10 in the manner described previously, is connected, to a high-pressure output by means of the whip 103, the pressure gauge 3, equipped with a screen display 203 and two LEDs 303.

Figure 3:
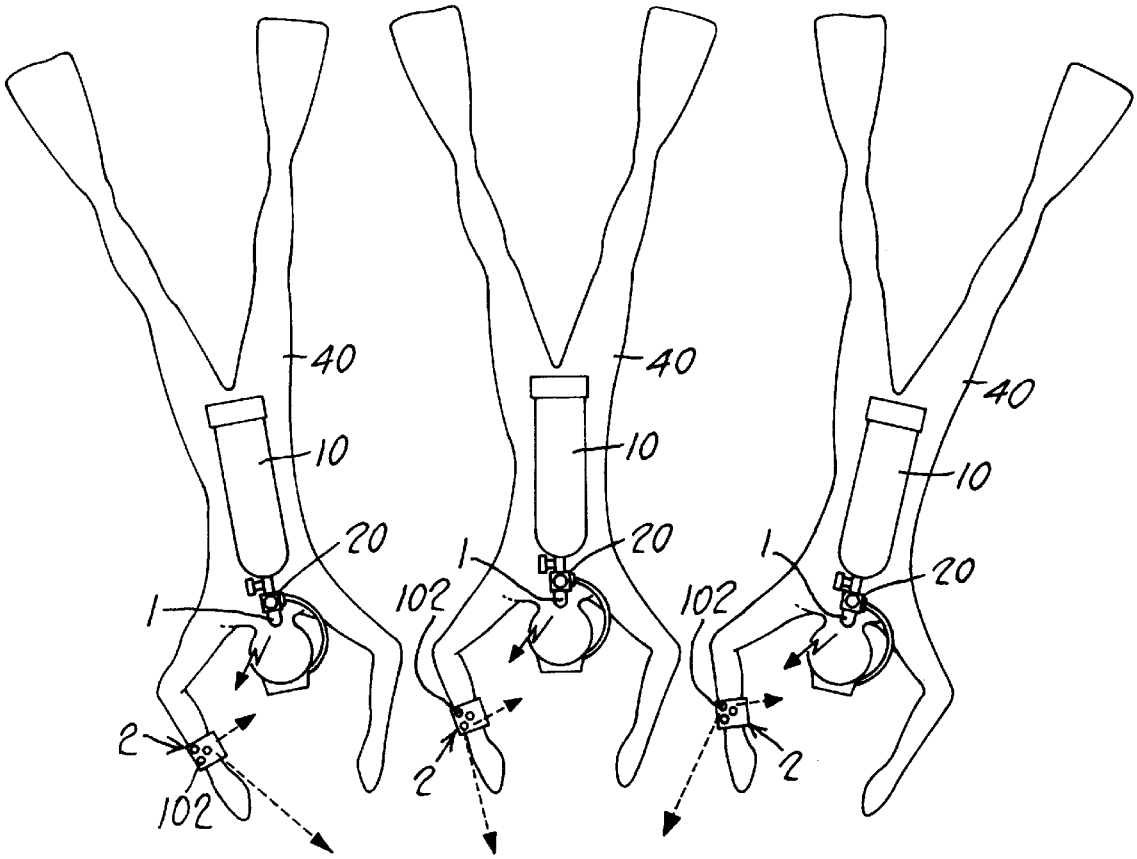
FIG. 3 is a schematic view of the operation of the device according to present invention.
Figure 3:
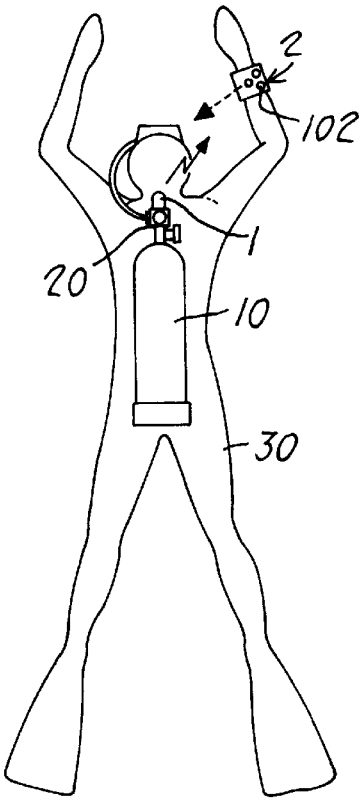

FIG. 3 is a schematic representation of the operation of the device according to the invention. The scuba diving instructor 30 can watch the computers for diving 2 of scuba diving pupils 40 for the lighting-up of the LEDs 102, caused by the signal transmitted to the computer 2 by the device 1 connected to the first reducer stage 20. When the pressure in the compressed-air tank 10, detected by the pressure sensor of the device 1 connected to the high-pressure output of the first reducer stage 20 (see FIG. 1), is a pre-critical or critical pressure, i.e., 100 bar or 50 bar, respectively, the corresponding LED 102 on the computer 2 will light up, and in this way the instructor 30 will be warned of the situation of danger that the corresponding pupil 40 is in.

Of course, a similar degree of effectiveness may be obtained by providing each pupil 40 with the pressure gauge 3 illustrated in FIG. 2. Also in this case, the pressure gauge detects the pressure datum owing to the fact that it is connected to the high-pressure output of the first reducer stage 20 of the two-stage breathing apparatus with which the diver is equipped. Subsequently, the pressure value is transmitted to a transducer circuit located inside the pressure gauge itself, and consequently not shown in FIG. 2. If this value corresponds to one of the values given for which one of the two LEDs 303 should light up, i.e., 100 bar or 50 bar, the corresponding LED will light up.

In the case of the LEDs arranged on the computer 2, it is possible, on account of the data processing capacity of said computer, for one of the LEDs 102 to warn also how near the pupil is to going outside the diving safety curve, in so far as this datum is commonly processed by said scuba diving computers.

Figure 4:
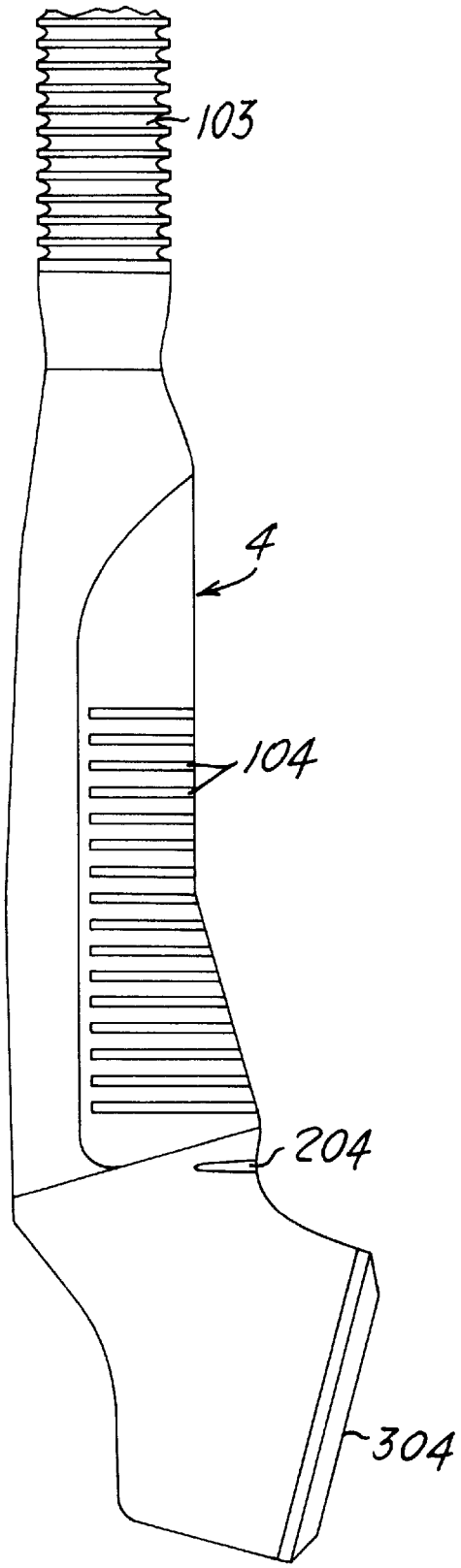
FIGS. 4 and 5 are respectively a side and a front view of a diving computer which is particularly suitable to the use with the present invention.
Figure 5:
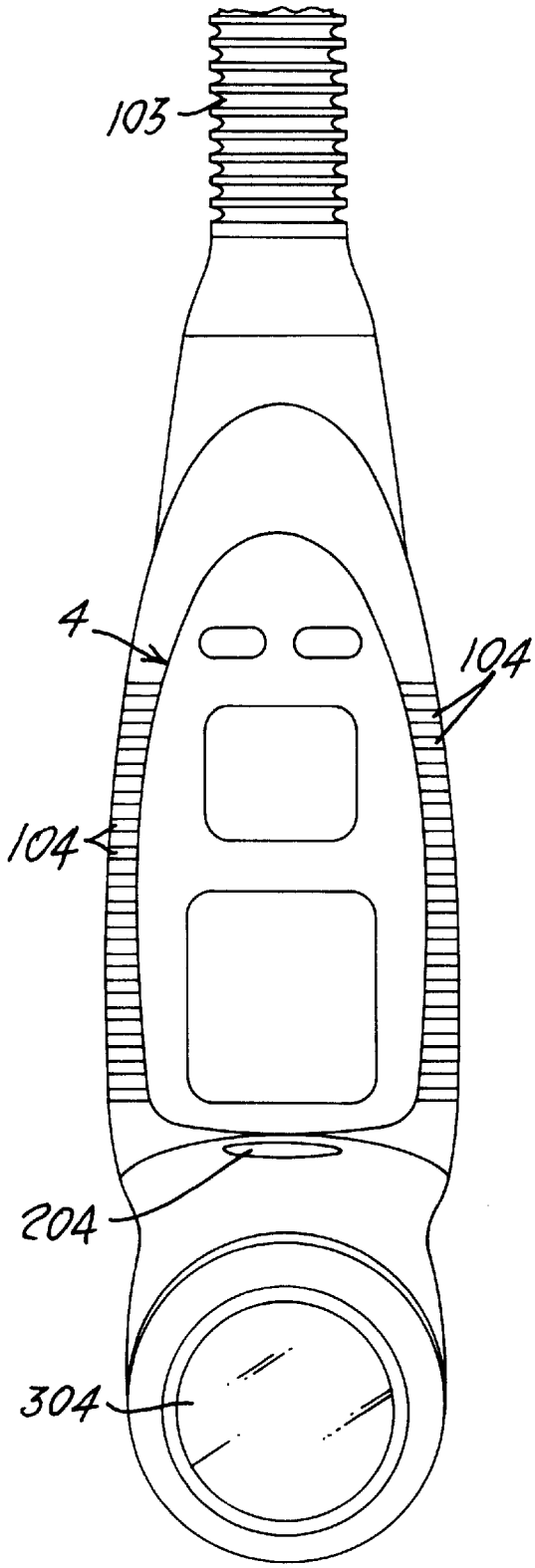

With reference to FIGS. 4 and 5, still another embodiment of the warning device according to the invention will be described. The device shown comprise a computer 4, similar to computer 2 of the embodiment of FIG. 1, which is connected to a high-pressure output by means of the whip 103. The computer 4 is provided at least on one side, but advantageously on both sides, as shown, with a row of LEDs 104, which will be sequentially lighted in function of the air pressure in the bottles of the diver. Thanks to the above the instructor is in condition to watch at any time at distance the conditions of danger of the pupils. By numeral 204 a LED is shown giving an indication during the decompression cycle.

The warning means here exemplified therefore include optical warning devices, but it is evident that similar results may be obtained using acoustic warning devices, or another warning devices that utilize electromagnetic waves, such as radio waves or the like. Obviously, in such a case the instructor must be equipped with adequate receiver apparatus.

We claim:

1. Device for giving warning of conditions of danger for scuba diving comprising means of detection of the pressure in compressed-air tanks, means of transducing datum detected, and means of indicating the datum in a manner such that when the device is worn by a first scuba diver the datum is easily detected by a second scuba diver positioned at a distance from the first scuba diver.

2. Device according to claim 1 wherein said means of detection are connected to a high-pressure output of a first reducer stage of the two-stage breathing apparatus.

3. Device according to claim 2 wherein said means of detection include a pressure sensor, and said transducing means include a circuit that converts the pressure detected into a pulse and a circuit that transmits it to a warning means, said means of warning including LEDs of different colours arranged on a control panel of a computer for scuba diving.

4. Device according to claim 2 wherein said means of detection include an analogue or digital pressure gauge, the transducing means comprise an electrical circuit which transmits the datum to said means of warning including LEDs of different colours arranged on said pressure gauge.

* * * * *